United States Patent [19]

Kraft et al.

[11] 4,195,964

[45] Apr. 1, 1980

[54] ARRANGEMENT FOR REDUCING GAP LOSSES IN THE ADJUSTABLE GUIDE VANES OF FLUID FLOW MACHINES, PARTICULARLY GAS TURBINE ENGINES

[75] Inventors: Eckhard Kraft, Munich; Volker Lunneman, Bachern, both of Fed. Rep. of Germany

[73] Assignee: Motoren- und Turbinen-Union München GmbH, Munich, Fed. Rep. of Germany

[21] Appl. No.: 933,191

[22] Filed: Aug. 14, 1978

[30] Foreign Application Priority Data

Sep. 7, 1977 [DE] Fed. Rep. of Germany ..... 2740192

[51] Int. Cl.[2] ..... F01D 11/00; F01D 17/12

[52] U.S. Cl. ..... 415/160; 29/156.8 R

[58] Field of Search ..... 415/160, 161, 162, 163, 415/164, 174; 277/236; 29/156.8 R, 527.2

[56] References Cited

U.S. PATENT DOCUMENTS

| | | | |
|---|---|---|---|
| 1,478,053 | 12/1923 | Overn, Jr. | 415/161 |
| 1,817,654 | 8/1931 | Terry | 415/163 X |
| 3,788,763 | 1/1974 | Nickles | 415/160 X |
| 3,995,971 | 12/1976 | White | 415/160 |

FOREIGN PATENT DOCUMENTS

| | | | |
|---|---|---|---|
| 67182 | 1/1951 | Netherlands | 29/156.8 R |
| 578034 | 6/1946 | United Kingdom | 415/163 |

*Primary Examiner*—Leonard E. Smith

*Attorney, Agent, or Firm*—Scully, Scott, Murphy & Presser

[57] ABSTRACT

An arrangement for reducing the gap formed by the adjustable axial-flow guide vanes of fluid flow engines, such as gas turbine engines, between the root-sided lower edges of the vane airfoil and the thereto contiguous outer wall of an annular flow passageway. Grooves are formed in the outer wall of the flow passageway above a leading and/or trailing lower edge of the vane airfoil; a soft vane base-covering coating filling said grooves; and recesses formed in the coating-filled grooves slightly above the pivot plane of the respective lower vane edges.

3 Claims, 3 Drawing Figures

ARRANGEMENT FOR REDUCING GAP LOSSES IN THE ADJUSTABLE GUIDE VANES OF FLUID FLOW MACHINES, PARTICULARLY GAS TURBINE ENGINES

BACKGROUND OF THE INVENTION

1. Field of the Invention

The present invention relates to an arrangement for the reduction of the gaps which are formed with variable axial-flow guide vanes of fluid flow machines, particularly gas turbine engines, between the root-sided lower edges of the airfoil or blade and the therewith contiguous outer wall of an annular flow passageway.

As a result of the above-mentioned gaps there may be produced a so-called "secondary flow" from the pressure to the suction side of the adjustable guide vanes which, for instance, in an adjustable guide vane baffle of an axial-flow compressor, in addition to aerodynamic disruptions, may lead to an irregular pressure distribution downstream of the guide vanes and, consequently, to not insignificant power losses.

2. Discussion of the Prior Art

In the interest of effecting a reduction in the gap, particularly with regard to the annular chambers which reduce conically in the flow direction as, for example, those in axial-flow compressors, there are presently encountered not insignificant constructional difficulties in attempting to maintain the above-mentioned gap as small as possible over the entire adjusting range of the adjustable guide vanes.

SUMMARY OF THE INVENTION

Accordingly, it is a primary object of the present invention to provide an arrangement by means of which, in a relatively simple manner, there is reduced to a minimum the gap forming between the respective lower edges of the guide vanes and a contiguous outer housing wall in the interest of affording the lowest possible gap losses.

It is a more specific object of the present invention to provide an arrangement in which grooves formed in the outer wall of the flow passageway above a leading and/or trailing lower edge of the vane airfoil are filled with a soft coating at the start of the vane, into which recesses have been worked by means of a tool or, respectively, vane simulator, slightly above the pivot plane of the respective lower edges of the vane.

BRIEF DESCRIPTION OF THE DRAWINGS

Preferred embodiments of gap reducing arrangements pursuant to the present invention are now described in detail, having reference to the accompanying drawings, in which.

DETAILED DESCRIPTION

Figure 1:
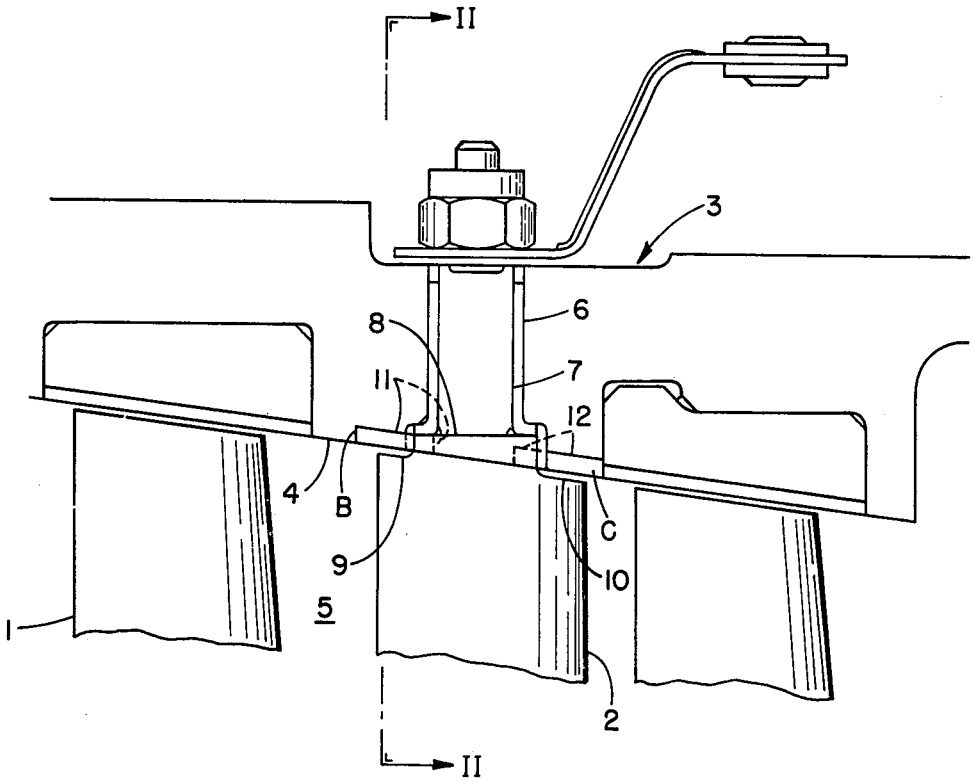
FIG. 1 is an axial sectional view illustrative of a portion of an outer compressor casing in association with an adjustable guide vane of a compressor stage equipped with an arrangement pursuant to the present invention.

Referring to FIG. 1 of the drawings, the numerals 1 and 2 designate, respectively, the rotor blades and guide vanes of a compressor stage of an axial-flow compressor for a turbojet engine. The guide vanes 2 of this compressor stage are pivotally supported in the outer compressor casing 3. An annular flow passageway 5 increasingly reducing in cross-section in the flow direction of the compressor air is formed on the basis of the outer wall 4 of the compressor casing 3 and an inner casing wall (not shown).

The present neck portion of each of the guide vanes 2 consists of a pivot pin 7 which is supported in a bushing 6, as well as a plate-shaped portion 8 on the lower end of the guide vanes.

As may also be ascertained from FIG. 1, grooves 11, 12 are so positioned in the outer casing wall 4, and namely above the respective leading and trailing lower edges 9, 10 of the vane airfoil for effectuating the inventive arrangement, so as to cover lower vane edges 9, 10 over the entire range of adjustment of the guide vanes 2.

After the grooves 11, 12 have been machined into the outer casing wall such as, for example, by turning or milling, they are filled with a soft coating B, C covering the vane base, such as can be employed, amongst other applications, as a sealing coating between an outer wall of the fluid flow engine and the adjoining external blade ends of rotor blades.

A suitable coating for the grooves 11, 12 which is adapted to the inventive purpose can be constituted, for example, of a 60% aluminum alloy containing a 12% silicon component, as well as up to 40% polyester.

After the setting of the vane base-covering coating B, C, there are drilled the casing bores for the pivot pins 7 and the plate-shaped portions 8.

Figure 2:
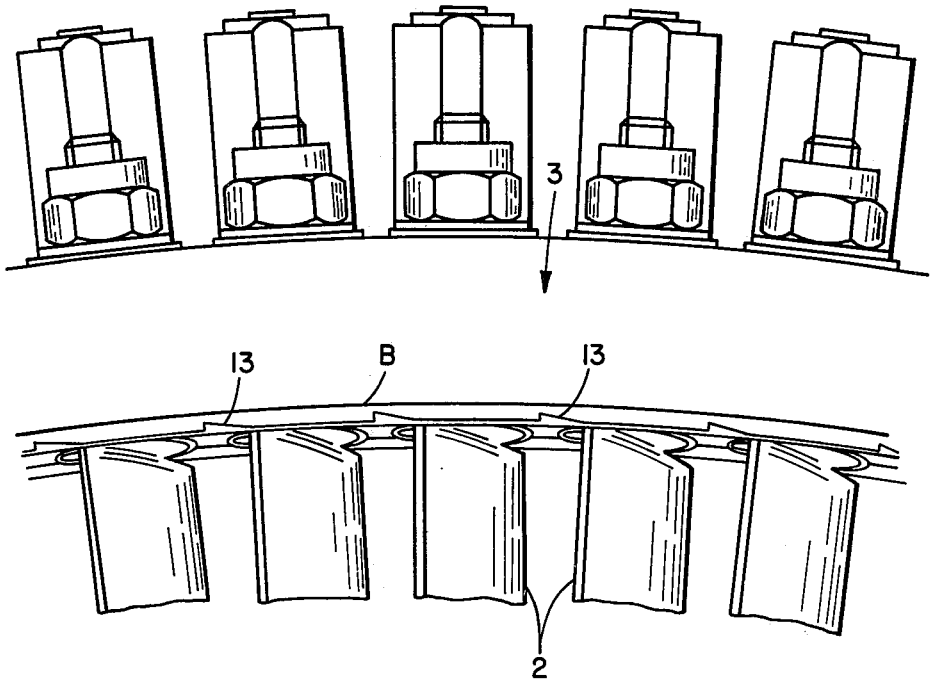
FIG. 2 is a section taken along line II—II in FIG. 1 and illustrates the compressor outer casing section with the adjustable guide vanes.

Through the intermediary of a vane simulator operating as a tool, whose plate height is somewhat lower than the respective plate height of portion 8 of the actual guide vanes which are to be installed later, this simulator scrapes recesses out of the vane base-covering coatings B, C through rotation of this simulator within the respective guide vane bores, which lie slightly above the pivot planes of the respective guide vane lower edges 9, 10 of the later to be installed guide vanes 2; referring herein to the recesses 13 in coating B as shown in FIG. 2 for the entire pivoting range of the leading lower vane edge 9.

Notwithstanding the cylindrical, as well as the reducing contour in the axial direction of the outer wall 4 of the compressor casing 3, in effect a contour normally necessitating relatively large gaps between the lower edges of the vanes and the adjacent outer casing wall, it is thus possible to arrange the guide vanes 2 over their entire adjusting range while affording only a minimal, constant gap between the respective lower vane edges 9, 10 and the base-covering coatings B, C.

Figure 3:
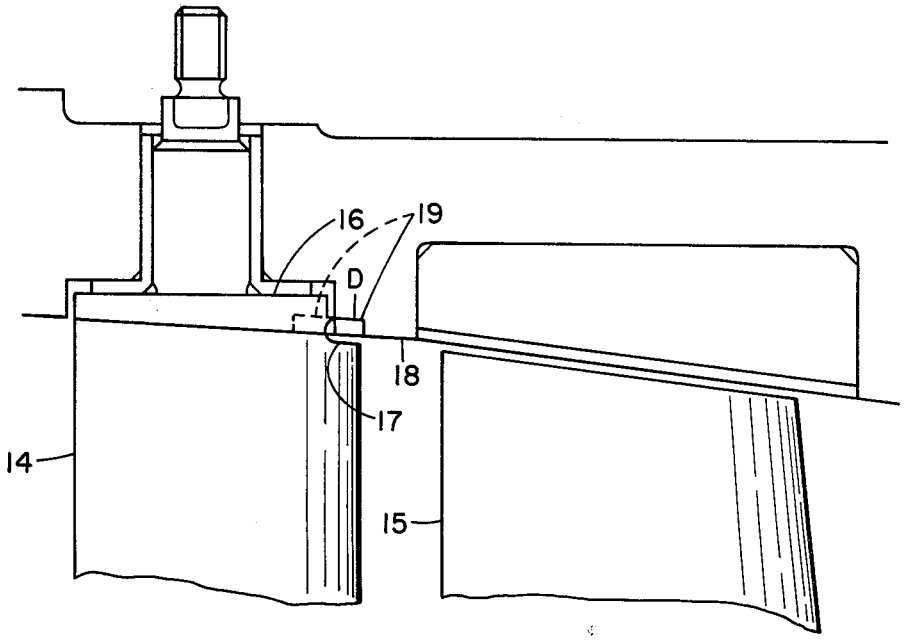
FIG. 3 illustrates a modified embodiment of the arrangement of FIG. 1 on an adjustable inlet guide vane with the associated compressor outer casing portion.

FIG. 3 of the drawings illustrates a modified embodiment of the arrangement in accordance with the present invention on an adjustable inlet guide vane 14 of an axial-flow compressor. A compressor rotor blade of the first compressor stage located downstream of the inlet guide vane 14 is designated by the reference numeral 15. The inlet guide vane 14 is so constructed that the associated plate-shaped section 16 of the blade neck reaches to the leading edge of the vane. In the embodiment of FIG. 3, there is thus merely produced a gap between the trailing lower vane edge 17 and the adjoining outer casing wall 18, whereby this gap is minimized in a manner previously discussed with respect to FIGS. 1 and 2. In FIG. 3, the groove which is machined into the compressor casing so as to accommodate a vane base coating D is designated by the reference numeral 19.

The invention is also applicable in the same sense to axial-flow turbines (adjustable guide vanes in a power turbine or the like) whereby, above all, attention must be given to the temperature stability of the base coating for the respective circumferential grooves.

It is to be self-understood by one skilled in the art that the inventive concept also encompasses the use of the invention in axial-flow blowers.

What is claimed is:

1. In an arrangement for reducing the gap formed by the adjustable axial-flow guide vanes of fluid flow engines, such as gas turbine engines, between the root-sided lower edges of the vane airfoil and the thereto contiguous outer wall of an annular flow passageway; the improvement comprising grooves formed in the outer wall of said flow passageway above a leading and/or trailing lower edge of the vane airfoil; a soft vane base-covering coating filling said grooves; and recesses being formed in said coating-filled grooves slightly above the pivot plane of the respective lower vane edges.

2. Arrangement as claimed in claim 1, said recesses being formed by a vane-simulating tool.

3. Arrangement as claimed in claim 1, said coating in said grooves at least partially encompassing a generally plate-shaped section of the vane neck portion of said adjustable guide vanes.

* * * * *